US007534976B2

(12) United States Patent
Crutcher

(10) Patent No.: US 7,534,976 B2
(45) Date of Patent: May 19, 2009

(54) VACUUM RECLOSER

(75) Inventor: Bernard C. Crutcher, Londonderry, NH (US)

(73) Assignee: FCI Americas Technology, Inc., Carson City, NV (US)

( * ) Notice: Subject to any disclaimer, the term of this patent is extended or adjusted under 35 U.S.C. 154(b) by 274 days.

(21) Appl. No.: 11/586,970

(22) Filed: Oct. 25, 2006

(65) Prior Publication Data

US 2007/0295691 A1 Dec. 27, 2007

Related U.S. Application Data

(60) Provisional application No. 60/816,654, filed on Jun. 26, 2006.

(51) Int. Cl.
*H01H 33/28* (2006.01)

(52) U.S. Cl. ..... 218/120; 218/140; 218/153

(58) Field of Classification Search ..... 200/48 R, 200/400, 401, 561; 218/7, 9, 10, 14, 78, 218/84, 120, 140, 153, 154
See application file for complete search history.

(56) References Cited

U.S. PATENT DOCUMENTS

| | | | | |
|---|---|---|---|---|
| 3,247,347 A | | 4/1966 | Lindsay | 200/144 |
| 3,567,887 A | | 3/1971 | Maloney | 200/153 |
| 3,727,019 A | | 4/1973 | Harvey | 200/144 B |
| 3,769,477 A | * | 10/1973 | Chabala et al. | 218/14 |
| 4,049,936 A | * | 9/1977 | Frink et al. | 218/12 |
| 4,105,878 A | | 8/1978 | Date et al. | 200/146 |
| 4,495,390 A | | 1/1985 | Leppers et al. | 200/145 |
| 4,661,662 A | | 4/1987 | Finke et al. | 200/48 |
| 5,507,671 A | | 4/1996 | Chadbourne et al. | 439/783 |
| 5,912,604 A | | 6/1999 | Harvey et al. | 335/9 |
| 6,362,445 B1 | | 3/2002 | Marchand et al. | 218/155 |
| 2004/0144757 A1 | | 7/2004 | Rhein et al. | 218/120 |

OTHER PUBLICATIONS

"AMPACT* In-Line Disconnect Assemblies", product information sheet 408-4097, Feb. 1996, pp. 1-4.
"TriMod® 300 Three Phase Vacuum Recloser", product information sheet DB 706-301, Jul. 2002, 4 pages.
"Scada-Mate® Switching Systems", product information sheet, Mar. 15, 2006, 2 pages.
"S&C TripSaver™ Dropout Recloser For enhanced lateral circuit protection at 15.5kV and 25 kV", Descriptive Bulletin 461-30, May 15, 2006, 8 pages.

* cited by examiner

*Primary Examiner*—Elvin G Enad
*Assistant Examiner*—Marina Fishman
(74) *Attorney, Agent, or Firm*—Harrington & Smith PC

(57) ABSTRACT

A vacuum recloser including a first connection section adapted to connect to a first electrical conductor; a second connection section mechanically connected to the first connection section; and an arm connected between the first and second connection sections. The second connection section is adapted to connect to a second electrical conductor. The arm includes a vacuum bottle section with contacts that are movable into and out of contact with each other for respectively electrically connecting and disconnecting the first and second connection sections with each other. The arm is movable to electrically disconnect the vacuum bottle section from one of the connection sections.

23 Claims, 2 Drawing Sheets

VACUUM RECLOSER

CROSS REFERENCE TO RELATED APPLICATION

This application claims priority under 35 U.S.C. §119(e) to U.S. provisional patent application No. 60/816,654 filed Jun. 26, 2006 which is hereby incorporated by reference in its entirety.

BACKGROUND OF THE INVENTION

1. Field of the Invention

The invention relates to an electrical connection system and, more particularly, to an apparatus for opening and closing an electrical path between conductors.

2. Brief Description of Prior Developments

U.S. Pat. No. 3,727,019 discloses a vacuum-type circuit interrupter. In the area of overhead high voltage electrical distribution wires, vacuum reclosers are sometimes used at electrical distribution poles to connect electrical conductors to each other and allow for automatically opening an electrical path load-break between the conductors based upon predetermined conditions. These conventional vacuum reclosers do not have an in-line design, and instead must be supported by the electrical distribution poles with mounting hardware, such as a support platform attached to the pole. Joslyn Hi-Voltage of Cleveland, Ohio sells a three Phase vacuum recloser know as the TRIMOD 300. In-line disconnect assemblies designed to physically open a line that is not electrically energized (also known as non-loadbreak) for electrical distribution wires are know, such as the AMPACT 83881 by Amp Inc. of Harrisburg, Pa. for example. However, these in-line disconnect assemblies do not comprise an automatic type of vacuum recloser design.

There is a need for reducing costs associated with installing a vacuum recloser on a high voltage overhead electrical distribution wire. There is also a desire to conclusively indicate to a user that a vacuum recloser is in an open state where a visible air gap can be achieved during scheduled or required maintenance.

SUMMARY OF THE INVENTION

In accordance with one aspect of the invention, a vacuum recloser is provided including a first connection section adapted to connect to a first electrical conductor; a second connection section mechanically connected to the first connection section; and an arm connected between the first and second connection sections. The second connection section is adapted to connect to a second electrical conductor. The arm includes a vacuum bottle section with contacts that are movable into and out of contact with each other for respectively electrically connecting and disconnecting the first and second connection sections with each other. The arm is movable to electrically disconnect the vacuum bottle section from one of the connection sections.

In accordance with another aspect of the invention, a vacuum recloser is provided comprising a first system for opening and closing an electrical path between two connection sections of the vacuum recloser, and a second for opening and closing the electrical path between two connection sections of the vacuum recloser. The first system comprises a vacuum bottle section with contacts that are movable into and out of electrical connection with each other. The second system comprises a system for manually connecting and disconnecting an end of the vacuum bottle section with a second one of the connection sections.

In accordance with another aspect of the invention, a vacuum recloser is provided comprising a frame and an electrical connection section. The frame comprises a first section adapted to be connected to a first conductor, a second section adapted to be connected to a second conductor, and electrical isolators between the first and second sections which electrically isolate the first and second sections from each other. The electrical connection section is located between the first and second sections. The electrical connection section comprises a first end pivotably connected to the first section, a second end removably connected to the second section, and a vacuum bottle section between the first and second ends. The vacuum bottle section comprises electrical contacts which can be moved into and out of connection with each other to electrically connect and disconnect the first and second ends with each other. The vacuum recloser further comprises a section for moving the contacts into and out of electrical contact with each other. The first and second sections can be electrical disconnected from each other by the contacts in the vacuum bottle section or by removing connection of the second end of the electrical connection section with the second section.

In accordance with one method of the invention, a method of manufacturing a vacuum recloser is provided comprising providing a frame with a first section adapted to be connected to a first conductor, a second section adapted to be connected to a second conductor, and electrical isolators between the first and second sections which electrically isolate the first and second sections from each other; and connecting a vacuum, recloser section to the frame between the first and second sections, wherein the vacuum recloser section has a second end which is removably connected to the second section such that a user can manually disconnect the first and second sections from electrical connection with each other by mechanically disconnecting the vacuum recloser section from the second section.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
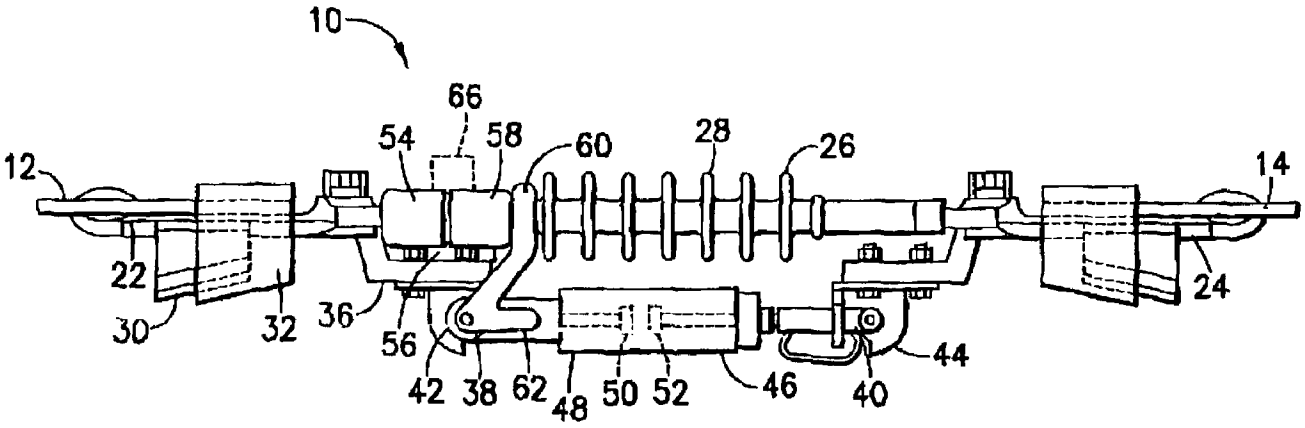
FIG. 1 is an elevational side view of a device incorporating features of the invention shown connected in-line between two conductors.

Referring to FIG. 1, there is shown an elevational side view of a vacuum recloser 10 incorporating features of the invention. Although the invention will be described with reference to the exemplary embodiment shown in the drawings, it should be understood that the invention can be embodied in many alternate forms of embodiments. In addition, any suitable size, shape or type of elements or materials could be used.

The vacuum recloser 10 is shown connecting a first electrical conductor 12 to a second electrical conductor 14. For example, the conductors 12, 14 could be high voltage overhead power distribution lines. However, the vacuum recloser 10 could be used in any suitable application. The vacuum recloser 10 forms a switch between the two conductors 12, 14. When the switch is open, the first and second conductors are not electrically connected to each other through the switch. When the switch is closed, the first and second conductors are electrically connected to each other through the switch. In this embodiment the vacuum recloser is an in-line design connected in-line between the two conductors 12, 14. However, in alternate embodiments, the vacuum recloser could be provided other than in an in-line design.

Figure 2:
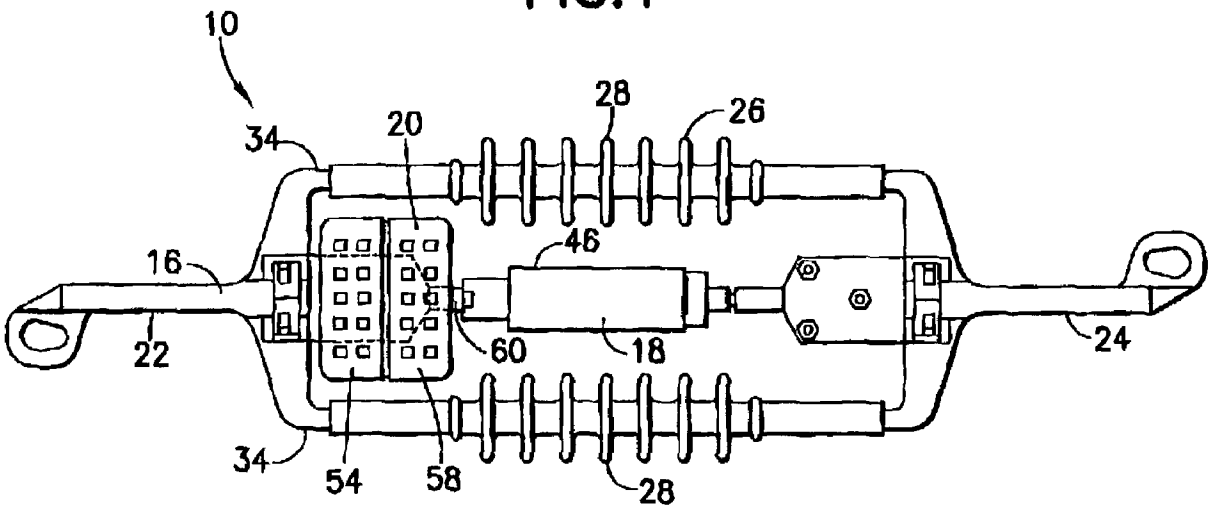
FIG. 2 is a plan top view of the device shown in FIG. 1.

Referring also to FIG. 2, the vacuum recloser 10 generally comprises a frame 16, an electrical connection section 18, and a control 20. The frame 16 generally comprises a first connection section 22, a second connection section 24, and an electrical isolation section 26. The electrical isolation section 26 structurally connects the first connection section 22 to the second connection section 24. In this embodiment the electrical isolation section 26 comprises two parallel sections 28. Each section 28 has two opposite ends connected to the first and second connection sections, respectively. An open area is formed between the two sections 28. Each section 28 comprises an electrical insulator assembly for electrically insulating the opposite ends of each section 28 from each other and, thus, electrically insulating the first and second sections 22, 24 from each other while still structurally connecting the sections 22, 24 to each other.

In this embodiment, the first and second sections 22, 24 are substantially mirror images of each other. However, in alternate embodiments the two sections 22, 24 could be different. The first connection section 22 is preferably comprised of metal, such as cast metal for example. The first connection section 22 generally comprises an integral wedge section 30 for use with a wedge connector shell 32 for connecting the first connection section 22 with the first conductor. One example of a wedge connector shell is described in U.S. Pat. No. 5,507,671 which is hereby incorporated by reference in its entirety. However, in alternate embodiments, any suitable system for mechanically and electrically connecting the first conductor 12 to the first connection section 22 could be provided. For example, a non-wedge compression connection or a non-wedge mechanical connection could be used. The first connection section 12 comprises two leg sections 34 and a bottom platform section 36. The leg sections 34 are connected to the sections 28 of the electrical isolation section 26. The bottom platform section 36 extends between and beneath the two leg sections. However, in alternate embodiments, the first connection section 22 could comprise any suitable shape. The second connection section 24 is identical to the first connection section; just reversely orientated.

The electrical connection section 18 generally comprises a first end 38 movably connected to the first connection section 22 and an opposite second end 40 movably connected to the second connection section 24. In this embodiment the first end 38 is pivotably connected to the platform section 36 of the first connection section by a pivot connection 42. However, in alternate embodiments, any suitable type of movable connection could be provided. The pivot connection 42 electrically connects the first end 38 to the first connection section 22. The second end 40 is removably connected to the platform section of the second connection section by a latch assembly 44. The latch assembly 44 electrically connects the second end 40 to the second connection section 24. The latch assembly could comprise a primarily friction latch assembly, for example, and could comprise a detent system for preventing unintentional disconnection of the second end 40 from the latch assembly 44.

The electrical connection section 18 forms a movable arm connected between the first and second sections 22, 24. The arm comprises the first and second ends 38, 40 and a vacuum bottle section 46 between the two ends 38, 40. The vacuum bottle section comprises an outer housing 48 and at least two contacts 50, 52 located inside the housing 48. The first contact 50 is adapted to be moved into contact with and out of contact with the second contact 52. The housing 48 could comprise a window to allow a user to view the location of the contacts 50, 52 relative to each other, or the vacuum bottle section 46 could have any other suitable type of visual indicator to signal a user of the open or closed state of the contacts 50, 52. When the contacts 50, 52 are in an open state, the first and second connection sections are not electrically connected to each other. When the contacts 50, 52 are connected to each other in a closed state (with the electrical connection section 18 in the closed configuration shown in FIGS. 1 and 2; contacting the latch assembly 44), the first and second sections 22, 24. are electrically connected to each other.

The control 20 generally comprises three sections; an inductively coupled power supply section 54, a recloser electronic control section 56, and a capacitive discharge and solenoid actuation section 58. These three sections could be mounted on a single printed circuit board as separate modules for example. The inductively coupled power supply section 54 generally comprises a current transformer. Electricity can be inductively generated by the power supply section which is stored by the capacitors and powers the control section 56. The recloser electronic control section 56 generally comprises a voltage monitoring section. The control section 56 can continuously monitor the voltage from the current transformer and, thus, monitor the current being transmitted through the vacuum closer 10 between the two conductors 12, 14. A memory is provided on the printed circuit board which contains pre-installed action criteria. The recloser electronic control section 56 can use this pre-installed action criteria and sensed real time conditions to determine if the contacts 50, 52 of the vacuum bottle section 46 should be opened to stop transmission of current through the vacuum recloser 10.

The capacitive discharge and solenoid actuation section 58 generally comprises capacitors and a solenoid 60. Electricity from the transformer can be stored in the capacitors for use in actuating the solenoid 60 when directed by the recloser electronic control section 56. The solenoid 60 is connected to the first contact 50 of the vacuum bottle section 46 by an armature mechanism 62. When the solenoid relay piston of the solenoid is moved outward, the armature mechanism 62 is adapted to move the first contact 50 out of contact with the second contact 52. Similarly, when the solenoid relay piston of the solenoid is moved inward, the armature mechanism 62 is adapted to move the first contact 50 into contact with the second contact 52. In one type of embodiment the solenoid is a bi-polar solenoid. However, any suitable solenoid could be used. Alternatively, any suitable type of armature drive system could be used.

Additionally, there will be a mechanical mechanism affixed to armature 60 that acts as a spring loaded trip mechanism where and when actuated by hand or hot stick 56 will trip (open) the contacts 50/52 of the vacuum bottle 18 to effectively disconnect electrical path 12 from 14. As a safety feature, there is preferrably no provisions for mechanically reconnecting (closing electrical continuity) between 12 and 14 by a manual action of closing 50/52 on vacuum bottle 10.

Figure 3:
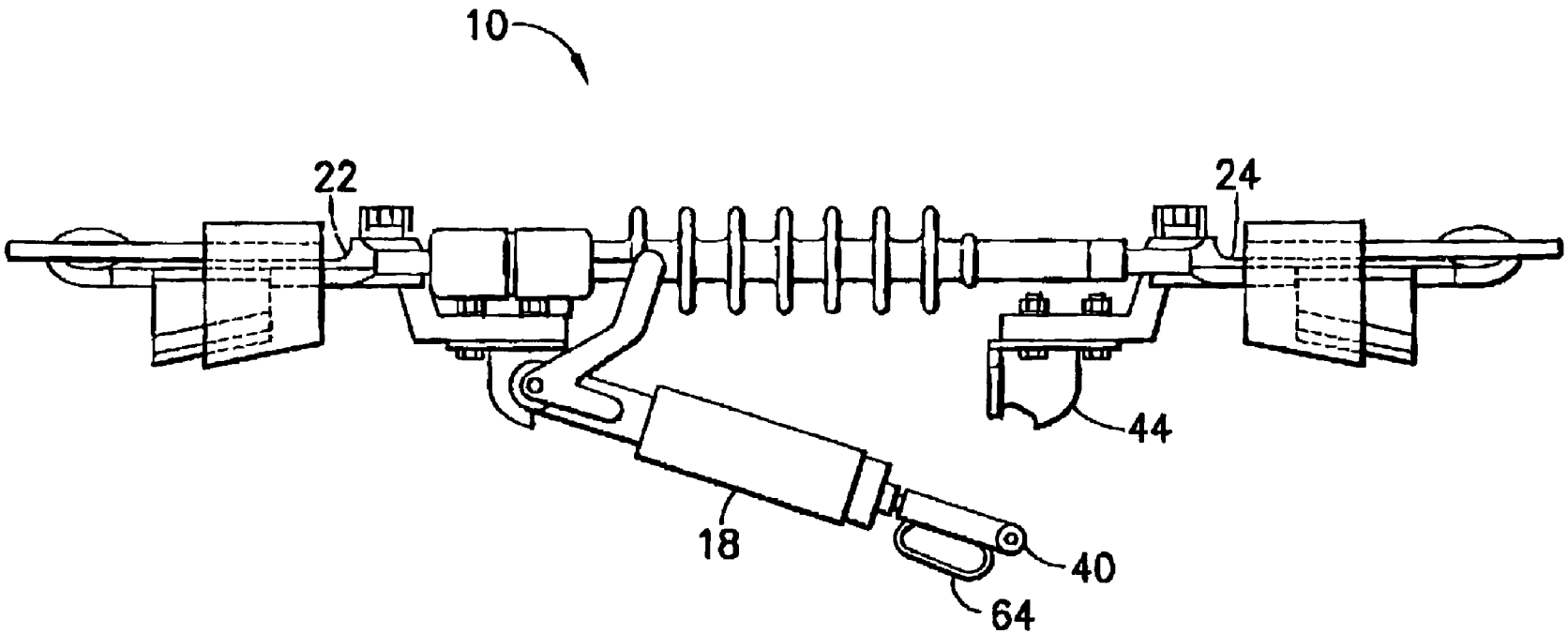
FIG. 3 is an elevational side view of the device shown in FIG. 1 with an arm of its electrical connection section moved to an open condition.

The control 20, in combination with the armature mechanism 62 and the vacuum bottle section 46 form a first system for opening and closing a path between the first and second connection sections 22, 24. This first system can function automatically based upon real time conditions, such as opening the switch when a downstream fault or other system overload is occurring. In addition to this first system, the vacuum recloser 10 comprises a second system for opening and closing the path between the first and second connection sections 22, 24. The second system allows a user to manually open and close the path by manually connecting and disconnecting the second end 40 of the vacuum bottle section with the second connection section 24. Referring also to FIG. 3, a further description will be provided.

FIG. 3 shows the vacuum recloser 10 in a manually open state. FIGS. 1 and 2 shown the vacuum recloser in a manually closed state. In the manually closed state, the contacts 50, 52 of the vacuum bottle section determine if the switch is opened or closed. In the manually open state, the switch is open regardless of the position of the contacts 50, 52 relative to each other. In the manually open state, the user has moved the second end 40 of the electrical connection section 18 away from connection with the latch assembly 44. This breaks the circuit path through the electrical connection section 18. The second end 40 has a handle 64 for the user to grasp or attach a hot stick to, in order to move the electrical connection section 18 to its open position. When the user is completed performing tasks downstream from the vacuum recloser, the user can then merely return the electrical connection section 18 back to its closed position shown in FIGS. 1 and 2. Cycling of the electrical connection section 18 between its manually open and manually closed positions could also be used to reset the solenoid 60 and armature mechanism back to a home state.

The invention relates to the development of components and devices to modify and improve the application of an in-line switch and will enable it to act as a vacuum recloser. The application of this switch in this fashion eliminates several costly processes and component parts to dramatically reduce production costs while offering similar performance with several additional labor saving and safety related enhancements. Key features include reduced cost, and an ability to unlock a vacuum bottle switch component and swing it down to visually and electrically isolate the downstream circuit for safety reasons. The invention is modular so as to allow offering a 1 phase version and 3 individual 1 phase versions acting in concert to perform single phase trip, 3 phase lockout. The present invention reduces the number of additional products typically required and associated with a typical vacuum recloser installation.

The invention could be offered as a switching device product that requires installation with a WEJTAP system, such as with the shells 32. The WEJTAP system is offered by FCI USA, Inc. under the BURNDY line of products. However, in alternate embodiments, any suitable type of connection system for connecting the assembly 10 with the electrical conductors 12, 14 could be provided. The invention could be incorporated into a distribution class (15-35 KVolt) switching device that is installed directly onto an aluminum bare conductor. The switching device can serve as a vacuum recloser, similar to conventional vacuum reclosers now commonly used and understood in their traditional, but the invention can comprise a novel feature that it is spliced directly in-line and mid span on the bare overhead conductor and not mounted on any supporting structure as they are now traditionally done. By suspending the switching device mid span, many expensive insulating and heavy mounting components are eliminated reduce its installation cost by 30% or more.

The invention can comprise an in-line switch frame, a vacuum bottle connected between energized sections of the in-line switch frame to serve as the switching medium, a driver circuit consisting of at least one solenoid relay for opening and closing the vacuum bottle mechanism, a voltage/current sensing and control circuit to continuous monitor electrical readings and provide intelligence for energy interruption during predetermined conditions that otherwise could be detrimental to the electrical system and other connected electrical components. The system could also comprise a one-way or a two-way communication circuit 66 (see FIG. 1) to allow communication between multiple components in close proximity, or communication to and/or from a remote central monitoring station. Any suitable communication circuit could be provided, such as a wireless cellular, IR optical, FM wireless, satellite or any other commonly used SCADA (Supervisory Control And Data Acquisition) communications device for example. For example, if the communication circuit 66 allows communication with a remote central monitoring station, the communication circuit 66 could inform the monitoring station when the switch is automatically opened. Additionally, or alternatively, the communication circuit 66 could be used by the monitoring station to remotely trigger changing of the switch in the vacuum bottle section from an open state to a closed state. This might be particularly advantageous for reaching lines which otherwise would be accessed by helicopter. A stored energy circuit could be provided that utilizes Ferro resistant technology to store capacitive energy to power the vacuum bottle switching, the voltage/current sense and control circuit, and the communication circuitry.

The set of contacts 50/52 can open and close to energize and de-energize the circuit while the switch remains in the visual representation shown in FIGS. 1 and 2. With a conventional vacuum recloser, the contacts inside the vacuum bottle cannot be seen visually and there is way by which a person can visually verify a vacuum bottle open or closed contact state; except to trust an indicator mechanism on the solenoid armature mechanism that the contacts are open or closed. The invention, on the other hand as shown by FIG. 3, allows a user to physically disconnected the vacuum bottle from one of the high-voltage transmission lines. Historically, a user has always been very nervous about trusting his or her life to the little armature mechanisms that say the contacts (which are inside the little bottle and cannot seen) are open or closed.

After installation, when the line is energized, the power supply module takes power inductively from the energized circuit and allocates it to the recloser control module and the capacitive module section. The recloser electronic control supplies the intelligence to make open/close decisions. Signals from the current transformer and the voltage monitoring section of the power supply module are fed into the electronic control and are continuously monitored. Its decision to act is based on a comparison of what it is seeing (real-time) on the line with what is stored into its pre-installed memory as action criteria. If a line fault or disturbance occurs, it will be fed real-time to the closure control module. If the sensed real-time conditions meet the criteria required for an opened or closed action, it will instruct one or more of the power capacitors to discharge. The discharging capacitors have the required power to cause the solenoid to open or close causing the solenoid relay piston to move forward or backward. The piston is connected through a mechanism that is, in turn, connected to the vacuum bottle armature. The completed action results in the vacuum bottle contacts being opened or closed rapidly.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. An electrical recloser comprising:

a first connection section adapted to connect to a first electrical conductor;

a second connection section mechanically connected to the first connection section, wherein the second connection section is adapted to connect to a second electrical conductor; and an arm connected between the first and second connection sections, wherein the arm comprises a circuit interrupter section with contacts that are movable into and out of contact with each other for respectively electrically connecting and disconnecting the first and second connection sections with each other, wherein the arm is movable to electrically disconnect the interrupter section from one of the connection sections, and wherein the interrupter section moves with the arm when the arm is moved.

2. An electrical recloser as in claim 1 wherein the recloser comprises a frame with the first and second connections sections and at least one electrical insulating section structurally connecting the first connection section to the second connection section.

3. An electrical recloser as in claim 1 further comprising a section for controlling opening and closing of the contacts in the interrupter section.

4. A vacuum recloser comprising:

a first connection section adapted to connect to a first electrical conductor;

a second connection section mechanically connected to the first connection section, wherein the second connection section is adapted to connect to a second electrical conductor;

an arm connected between the first and second connection sections, wherein the arm comprises a vacuum bottle section with contacts that are movable into and out of contact with each other for respectively electrically connecting and disconnecting the first and second connection sections with each other, and wherein the arm is movable to electrically disconnect the vacuum bottle section from one of the connection sections; and a section for controlling opening and closing of the contacts in the vacuum bottle section, wherein the section for controlling opening and closing of the contacts in the vacuum bottle section comprises an inductively coupled power supply module, a recloser electronic control module, and a capacitive discharge and solenoid actuation module.

5. An electrical recloser as in claim 1 wherein the arm is pivotably connected to the first connection section by a connecting platform.

6. An electrical recloser as in claim 1 wherein the arm comprises a first end movably connected to the first connection section, and an opposite second end removably connected to the second connection section.

7. An electrical recloser as in claim 1 further comprising a first means for opening and closing an electrical path between the first and second connection sections comprising the contacts of the interrupter section which are movable into and out of electrical connection with each other.

8. An electrical recloser as in claim 7 further comprising a second means for opening and closing the electrical path between the first and second connection sections, wherein the second means comprises means for manually connecting and disconnecting an end of the interrupter section with one of the connection sections.

9. An electrical recloser as in claim 1 further comprising a communicator for communicating with another device.

10. A vacuum recloser comprising:

a frame. comprising a first section adapted to be connected to a first conductor, a second section adapted to be connected to a second conductor, and electrical isolators between the first and second sections which electrically isolate the first and second sections from each other;

an electrical connection section located between the first and second sections, wherein the electrical connection section comprises a first end pivotably connected to the first section, a second end removably connected to the second section, and a vacuum bottle section between the first and second ends, wherein the vacuum bottle section comprises electrical contacts which can be moved into and out of connection with each other to electrically connect and disconnect the first and second ends with each other; and a section for moving the contacts into and out of electrical contact with each other, wherein the first and second sections can be electrical disconnected from each other by the contacts in the vacuum bottle section or by removing connection of the second end of the electrical connection section with the second section.

11. A vacuum recloser as in claim 10 wherein the section for moving the contacts comprises an inductively coupled power supply module, a recloser electronic control module, a capacitive discharge and solenoid actuation module, and an armature mechanism connecting a solenoid of the capacitive discharge and solenoid actuation module to one of the contacts in the vacuum bottle section.

12. A vacuum recloser as in claim 11 wherein the electronic connections section comprises a printed circuit board with the three modules coupled thereto.

13. A vacuum recloser as in claim 11 wherein the inductively coupled power supply module comprises a voltage monitoring section and a current transformer.

14. A vacuum recloser comprising:

a first system for opening and closing an electrical path between two connection sections of the vacuum recloser, the first system comprising a vacuum bottle section with contacts that are movable into and out of electrical connection with each other; and a second system for opening and closing the electrical path between the two connection sections, wherein the second system comprises a system for manually connecting and disconnecting an end of the vacuum bottle section with a second one of the connection sections, wherein the second system comprises an arm section connected between the two connection sections, wherein the arm section comprises the vacuum bottle section, wherein the end of the vacuum bottle section comprises a second end of the arm section, wherein a first end of the arm section is movably connected to a first one of the connection sections, and wherein the vacuum bottle section moves with the arm when the arm section is moved.

15. A vacuum recloser comprising:

a first system for opening and closing an electrical path between two connection sections of the vacuum recloser, the first system comprising a vacuum bottle section with contacts that are movable into and out of electrical connection with each other; and a second system for opening and closing the electrical path between the two connection sections, wherein the second system comprises a system for manually connecting and disconnecting an end of the vacuum bottle section with a second one of the connection sections, wherein the first system comprises an inductively coupled power supply module, a recloser electronic control module, a capacitive discharge and solenoid actuation module, and an armature mechanism connecting a solenoid of the capacitive discharge and solenoid actuation module to one of the contacts in the vacuum bottle section.

16. A vacuum recloser as in claim 14 wherein the first end of the arm is pivotably connected to a platform extending from the first connection section.

17. A method of manufacturing a vacuum recloser comprising:

providing a frame with a first section adapted to be connected to a first conductor, a second section adapted to be connected to a second conductor, and electrical isolators between the first and second sections which electrically isolate the first and second sections from each other; and connecting a vacuum recloser section to the frame between the first and second sections, wherein the vacuum recloser section has a second end which is removably connected to the second section such that a user can manually disconnect the first and second sections from electrical connection with each other by mechanically disconnecting the vacuum recloser section from the second section, wherein a first end of the vacuum recloser section is movably connected to the first section and an opposite second end of the vacuum recloser section is removably connected to the second section.

18. A method as in claim 17 wherein connecting the vacuum recloser section to the frame comprises pivotably mounting the first end of the vacuum recloser section to the frame.

19. A method as in claim 17 further comprising connecting a contact of the vacuum recloser section to a solenoid of a control by an armature mechanism.

20. A method of opening an electrical path in a vacuum recloser comprising:

manufacturing a vacuum recloser as in claim 17;

automatically opening the electrical path by separating contacting inside the vacuum recloser section;

additionally or alternatively manually disconnecting the end of the vacuum recloser section from the second section.

21. An electrical recloser as in claim 1 further comprising a section for controlling opening and closing of the contacts in the interrupter section, wherein the section for controlling opening and closing of the contacts in the interrupter section comprises an inductively coupled power supply module.

22. An electrical recloser as in claim 1 further comprising a section for controlling opening and closing of the contacts in the interrupter section, wherein the section for controlling opening and closing of the contacts in the interrupter section comprises a recloser electronic control module.

23. An electrical recloser as in claim 1 further comprising a section for controlling opening and closing of the contacts in the interrupter section, wherein the section for controlling opening and closing of the contacts in the interrupter section comprises a capacitive discharge and solenoid actuation module.

* * * * *